US006145576A

United States Patent [19]

Arana Eraña

[11] Patent Number: 6,145,576

[45] Date of Patent: Nov. 14, 2000

[54] MACHINE FOR COMPACTING SAND MOULDS BY AIR IMPACT OR EXPANSION WAVES

[75] Inventor: Agustin Arana Eraña, Vitoria, Spain

[73] Assignee: Loramendi, S.A., Vitoria, Spain

[21] Appl. No.: 09/125,231

[22] PCT Filed: Dec. 17, 1997

[86] PCT No.: PCT/ES97/00306

§ 371 Date: Aug. 13, 1998

§ 102(e) Date: Aug. 13, 1998

[87] PCT Pub. No.: WO98/26887

PCT Pub. Date: Jun. 25, 1998

[30] Foreign Application Priority Data

Dec. 17, 1996 [ES] Spain ..... 9602665
May 7, 1997 [ES] Spain ..... 9700977

[51] Int. Cl.[7] ..... B22C 15/272; B22C 15/28

[52] U.S. Cl. ..... 164/195; 164/169

[58] Field of Search ..... 164/169, 195, 164/37, 38

[56] References Cited

U.S. PATENT DOCUMENTS 4,529,026 7/1985 Kobel et al. .
5,476,136 12/1995 Leutwiler et al. ..... 164/169 X

FOREIGN PATENT DOCUMENTS 0263977 4/1988 European Pat. Off. ..... 164/195
0334787 9/1989 European Pat. Off. .
3417701 12/1984 Germany ..... 164/169
2-6036 1/1990 Japan ..... 164/169
2007886 7/1989 Spain .
2011685 2/1990 Spain .
2028178 7/1992 Spain .
2045554 1/1994 Spain .
1475762 4/1989 U.S.S.R. ..... 164/169

*Primary Examiner*—J. Reed Batten, Jr.
*Attorney, Agent, or Firm*—Ladas & Parry

[57] ABSTRACT

The machine has a pressure drum (1) capable of supplying a current of blowing air through the diffuser (2) towards the moulding box (3), and its characteristics are focused on a specific valve system in which a tubular valve body (7), to which the diffuser (2) is in turn solidly attached, is fixed to the mouth of the drum (1) with the assistance of a supporting frame (8), this assembly defining, with a large central core (15), a peripheral passage (16) for the outlet of air in which an inner valve seat (14) is established for a tubular membrane (11) that is fixed through its marginal areas to the marginal areas of the valve body (7), an enveloping chamber (12) being defined outside the same which, upon being pressurised, causes the membrane (11) to be choked against the seat (14) and consequently the valve to be closed. Opening of the valve (11–14) results, through the diffuser (2), in a jet of air which mainly concentrates on the perimetric area of the moulding box (3), improving sand compacting (5).

8 Claims, 7 Drawing Sheets

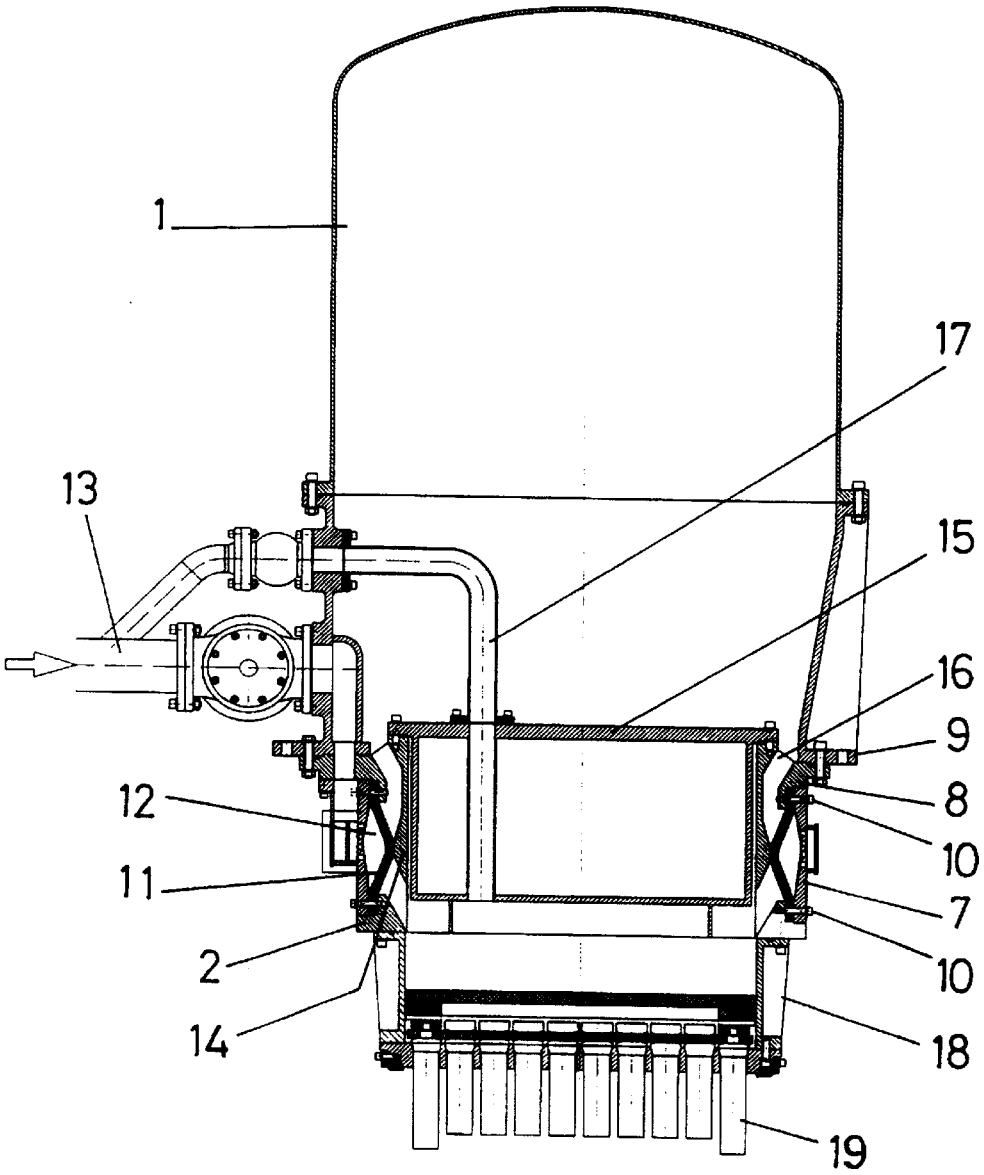
FIG.-4
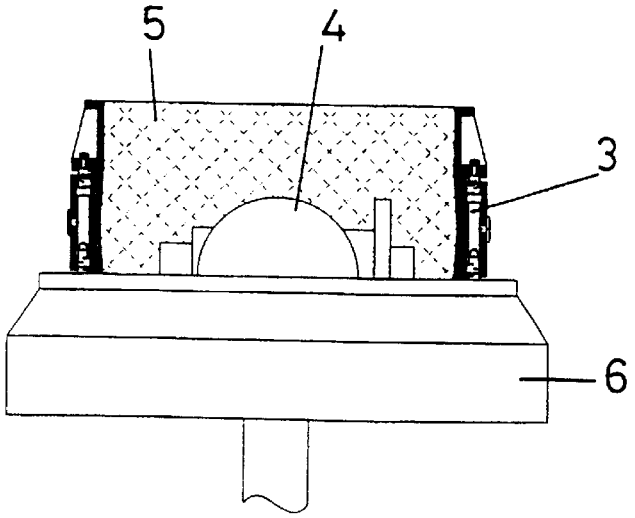

MACHINE FOR COMPACTING SAND MOULDS BY AIR IMPACT OR EXPANSION WAVES

OBJECT OF THE INVENTION

The present invention relates to a sand mould air impact or blast compacting machine, which machine has been substantially improved, specifically as regards its valve system to relate the compressed air-containing bell to the diffuser which projects air towards the sand mass, directly or with impact rams in between.

Accordingly, the invention is aimed at improving the functional features of the release valve, improving the compacting conditions and generally improving the functionality and versatility of the machine.

BACKGROUND OF THE INVENTION

Air impact sandbox moulding machines exist that use a release valve located between the bell and the diffuser, comprising a rigid disc or plate that is kept in the closed position by action of the overpressure existing in a chamber in which said plate plays, and hence upon the overpressure in such chamber disappearing, the accumulated air in the bell is capable of displacing the same to the open position, brusquely entering the diffuser and hitting the sand. Upon air under a greater pressure being again introduced in said chamber, in which the release valve plays, the latter moves back towards the closed position.

This solution results in brusque impacts and consequently noises when the closed position changes to the open position, but most importantly, after the release, the residual air has to be delivered through side ducts provided in the frame or close to the mouth of the diffuser, and thus its delivery causes sand particles to be dragged that significantly damage the machine because they are extremely abrasive.

Another known solution consists of using butterfly valves which, being of the mechanic kind, have a slow opening or closing response and the residual air must, as in the previous case, be removed through side ducts provided in the frame, with the same problems aforesaid.

A more advanced solution is described in a patent. It consists of using a highly elastic membrane as a delivery valve, solidly attached by means of two annular concentric flanges to a supporting plate within the bell body, thereby for a tightly sealed annular chamber to be configured between the membrane and its support, to which a compressed air supply duct has access, which membrane is operatively arranged facing a narrow annular seat and thus, when idle, an annular passage is established between the membrane and the seat, whereas when said annular chamber is applied pressure, the membrane is deformed and sealed tightly against its seat.

The main drawback of this solution, which it shares with the preceding cases, is a deficient compacting about the outer mould contour, or in other words, the inner moulding box contour. Deflectors are generally used to solve this problem, directing the air current towards the comers or edges of the moulding box, but this results in a substantial efficiency loss and further demands that very high impact pressures be used to achieve an effective compacting on the edges of the box.

Another solution to improve peripheral mould compacting is described in another patent. In it the air impact moulding machine is provided with a sand-supplying hopper axially arranged within the air release bell, and therefore both elements have direct access into the moulding chamber, the air outlet area from the bell being provided with a tube-shaped membrane valve that is axially deformed to open or close the passage of compacting air from the bell towards the sand mould. In addition to being more complicated due to the inclusion of the sand loading hopper at its central area, this machine moreover fully prevents the use of ancillary compacting systems, such as hydraulic rams for instance.

DESCRIPTION OF THE INVENTION

The sand mould air impact or blast compacting machine subject of the invention fully overcomes the above-mentioned drawbacks inasmuch as it allows air to be directed straight to the outer mould periphery or contour, i.e. the area where compacting is most effective, moreover leaving the central machine area clear, thereby to allow the inclusion of ancillary compacting means in such area, such as hydraulic rams or impact rams for instance.

To such end, and starting with the conventional construction of a machine of this kind based upon a pressure drum and a diffuser that channels the jet of air towards the moulding box, the primary features of the machine subject hereof lie in that a valve body having a generally square or rectangular contour, to which the diffuser is in turn coupled, is coupled to the mouth of the drum, through a supporting frame, a membrane being established within this valve body made up of four independent sectors tightly fixed to the valve body through the marginal areas thereof, an enveloping chamber being hence established outside such membrane, capable of inwardly deforming the same to establish a tight seal over the respective valve seat, when the pressure within such enveloping chamber is suitable, whereas in the absence of said pressure the tubular membrane is no longer deformed as before, and clears a peripheral passage established between the valve body and a central core, in which said valve seat is established, which largely closes the bottom of the drum.

In accordance with this construction, during the blowing stage, air reaches the diffuser and hence the moulding box as an annular, perimetric curtain, in a direction largely parallel to the drum axis, and the blowing pressure is thus at a maximum at the marginal or perimetric mould area.

Furthermore, the valve leaves the central or core machine area, where the residual air outlet is established, absolutely clear, which also allows ancillary compacting means, such as hydraulic rams, to be established.

The machine of the invention allows ancillary compacting means to be fitted, consisting of impact rams such as are described in a patent. To such end, a pan-shaped body, whose inner wall stands as a travelling guide for a rubber or metal plate lying on the heads of the impact rams, is coupled to the bottom of the diffuser, and therefore the air impact does not act directly on the sand but on the plate that in turn pushes the rams to compact the sand. With the valve system proposed herein, the air through the peripheral passage acts mostly on the outer contour of the plate and hence on the heads of the rams arranged on the periphery, thereby for compacting of the sand to be very effective at both the central and peripheral areas.

In a different embodiment, instead of including a single closing and opening valve, four valves are included to act independently on the four membrane sectors, which four valves will therefore act concurrently to achieve a total synchronism of the membrane sectors, in their closing and opening movements, and hence a uniform distribution of the compressed air and thus an optimum operation of the machine.

In this different embodiment, the membrane sectors are designed to be lie directly on the walls of the valve body, which has been found to lessen the noise and results in a longer service life of said membranes, for they must be moved over shorter distances to serve their function.

DESCRIPTION OF THE DRAWINGS

In order to provide a fuller description and contribute to the complete understanding of the characteristics of this invention, in accordance with a preferred practical embodiment thereof, a set of drawings is attached hereto as an integral part of the specification which, while purely illustrative and not fully comprehensive, shows the following:

FIG. 4.—Is a representation similar to that of FIG. 1, of a machine provided with the same valve system to which the invention specifically relates, albeit farther provided with an ancillary compacting system comprising a set of impact rams.

PREFERRED EMBODIMENT OF THE INVENTION

Figure 1:
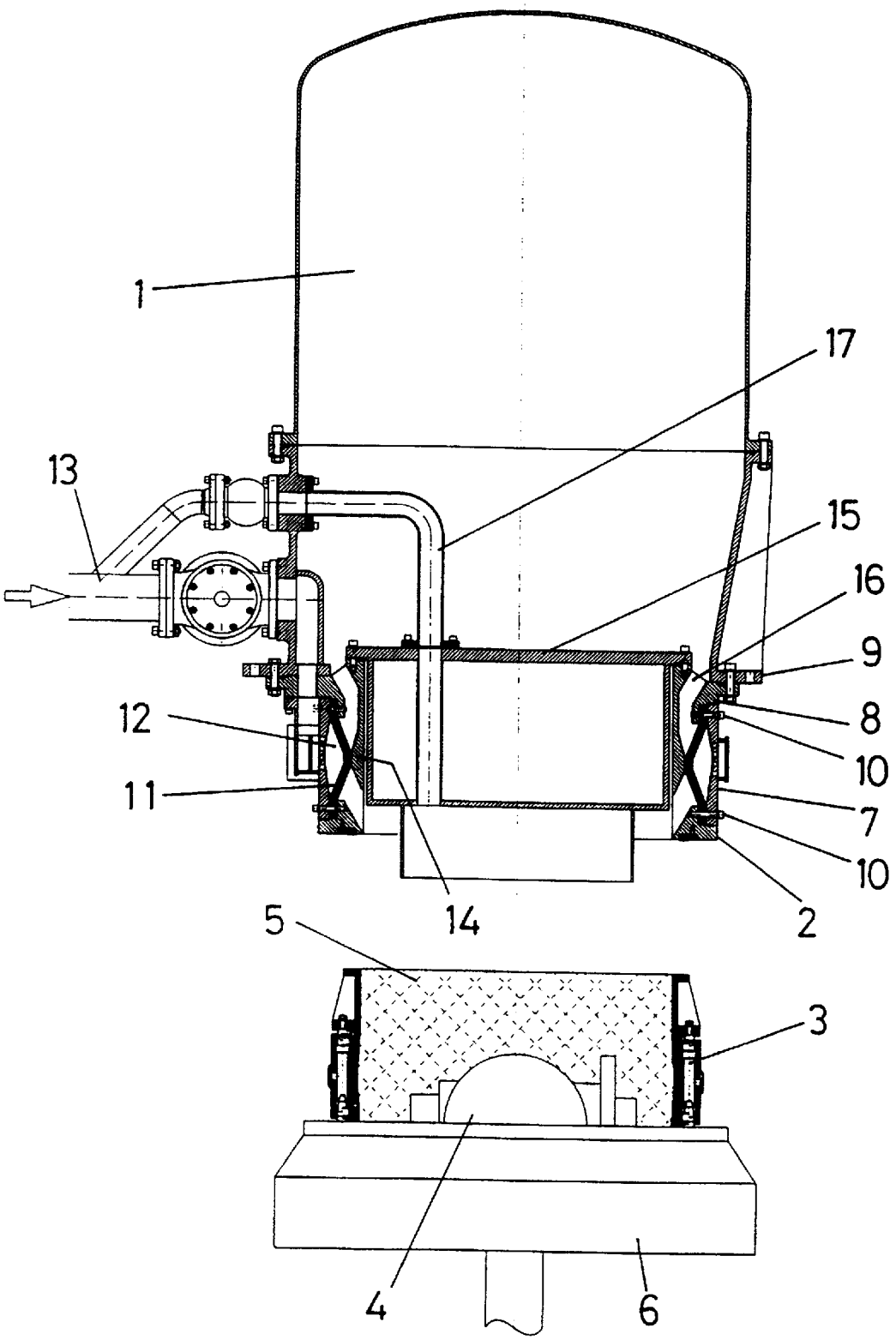
FIG. 1.—Is a diagrammatic side elevation and sectional representation of a sand mould air impact or blast compacting machine made in accordance with the improvements subject of the present invention, with its respective moulding box.
Figure 2:
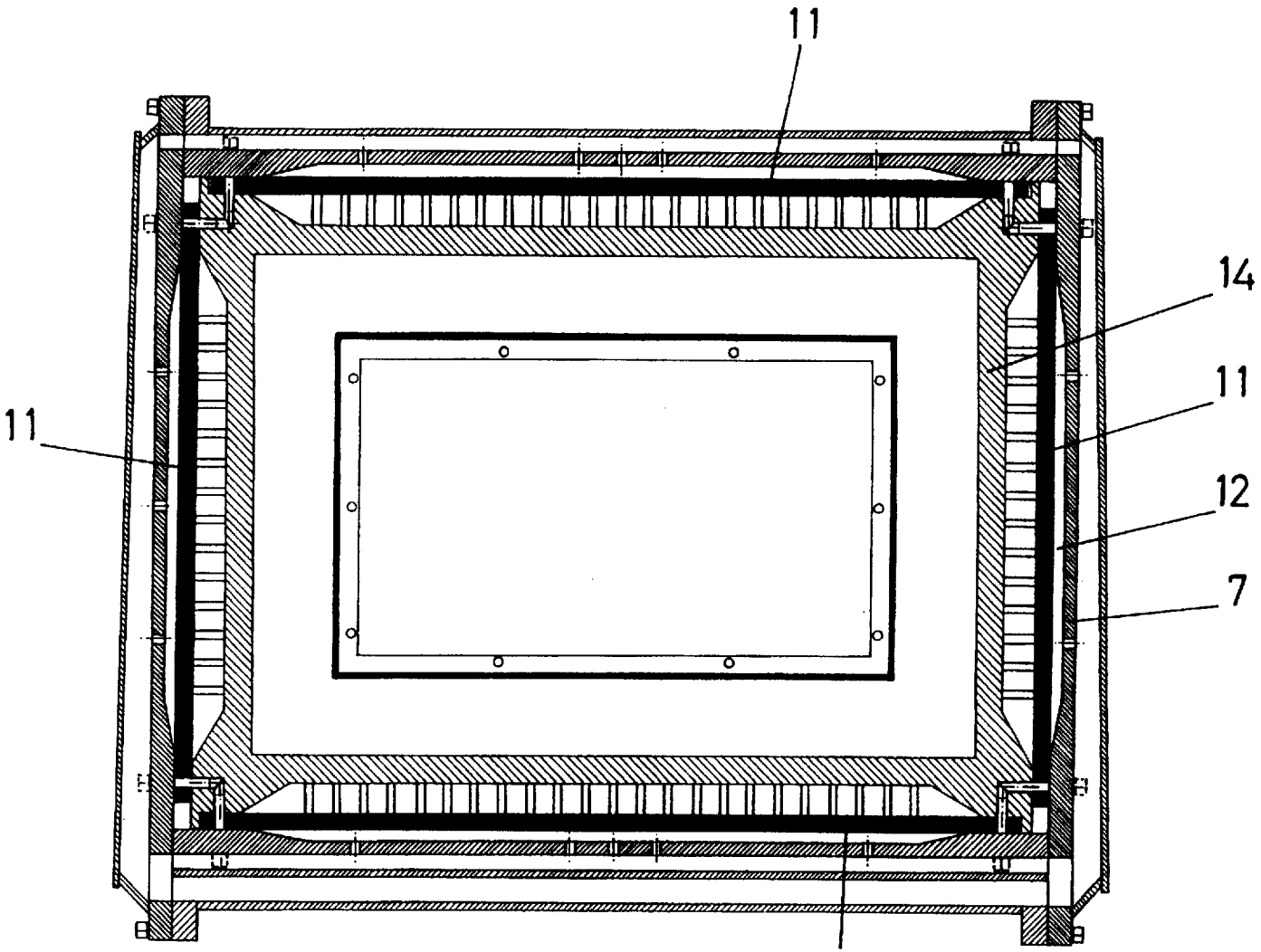
FIG. 2.—Is a sectional plan view of the sand mould air impact or blast compacting machine showing how the valve membrane comprises four independent sectors, the embodiment being one in which the valve membrane and respective body are rectangular in shape.

With reference to these figures and in particular FIG. 1, the machine subject hereof can be seen to be constructed, as any mould compacting machine of this kind, with a drum (1), capable of storing a sufficient quantity of compressed air, in order that, when its valve is opened, a blast is released through the diffuser (2) to the moulding box (3) carrying the pattern (4) and the sand mass (5), which are suitable for the part to be obtained and attachable to and detachable from said diffuser (2), by means of a lifting mechanism (6).

Now then, from this basic and conventional construction, the improvements of the invention are focused on the fact that the valve device comprises a valve body (7) having a generally square or rectangular contour, matching that of the moulding box (3), the bottom end of which is fixed to the diffuser (2), whereas the top end is fixed, with the assistance of a supporting frame (8), to the mouth (9) of the drum (1), the diffuser (2) and the supporting frame (8) having facing wings for the attachment, using screws (10) or any other suitable means, of the four marginal areas constituting the valve membrane (11), in order that between such membrane (11) and the valve body (7) an enveloping chamber (12) is established to which a suitable pressure is applied, through a duct (13), in order for the membrane (11) to be deformed against the seat (14) defined in an inner core (15) that largely closes the base of the drum (1) and which, together with the supporting frame (8), the actual valve body (7) and the bottom diffuser (2), defines a peripheral passage (16) for air, from the drum (1) to the moulding box (3), through said diffuser (2).

Figure 3:
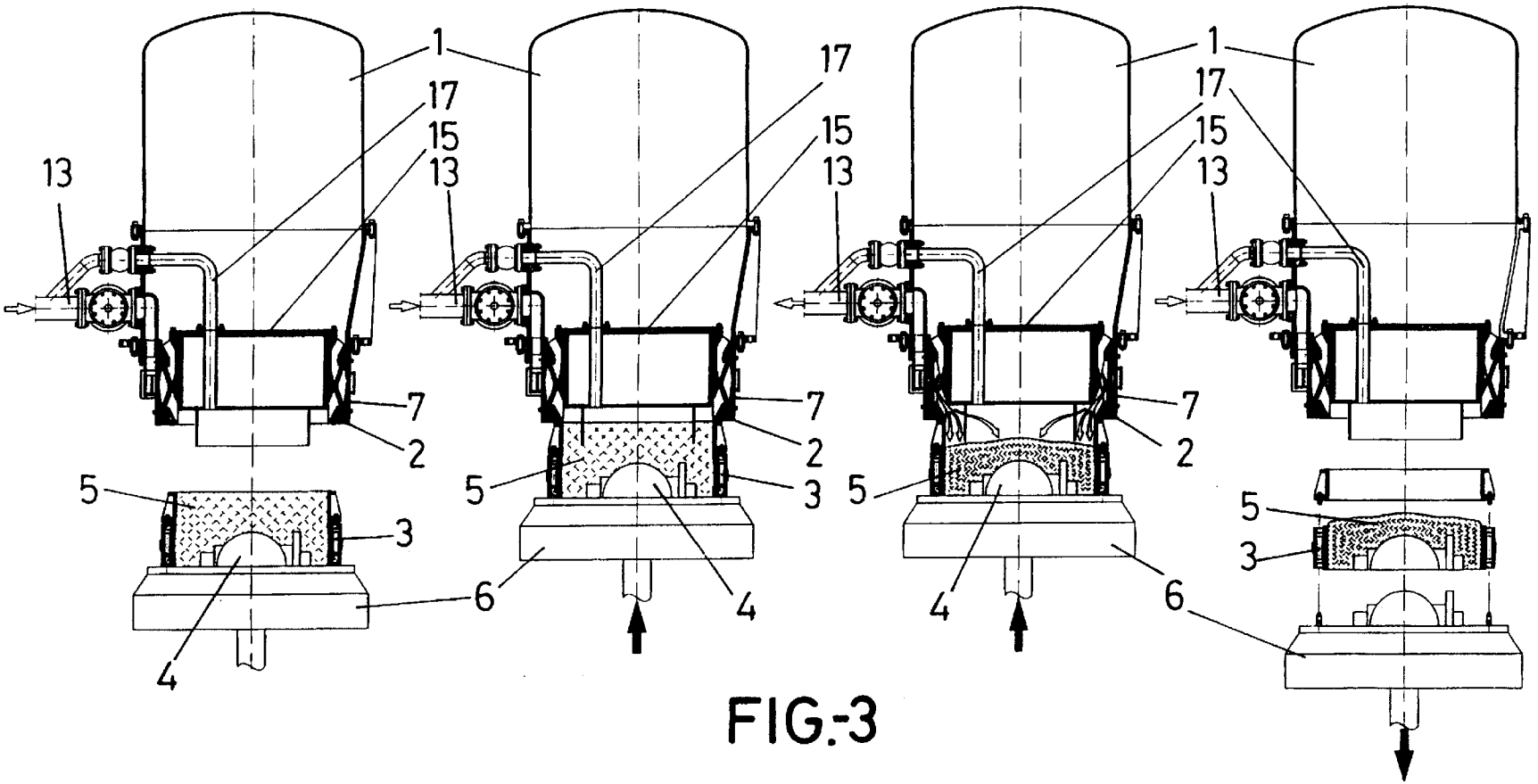
FIG. 3.—Shows the operating cycle of the machine of the previous figure, specifically the four essential stages thereof.

As shown in the operative sequences of FIG. 3 and starting with the first of such sequences, in which the moulding box (3) is shown detached from the machine, a rising movement thereof, in accordance with the second sequence of said figure, causes the moulding box (3) to be tightly coupled to the diffuser (2). At this time, the existing pressure in the enveloping chamber (12) is delivered, thereby for the tubular membrane (11) to move away from the seat (14), causing the valve to open and consequently a brusque delivery to take place from the drum (1), thereby for the blowing air arriving through the diffuser (2) to the moulding box (3), to hit its marginal or perimetric area, as shown in the third sequence of said FIG. 3. When the blowing stage is over, the moulding box (3) is detached from the machine, as shown in the fourth and final sequence of FIG. 3, thereafter to eliminate therefrom the respective finished sand mould.

Figure 5:
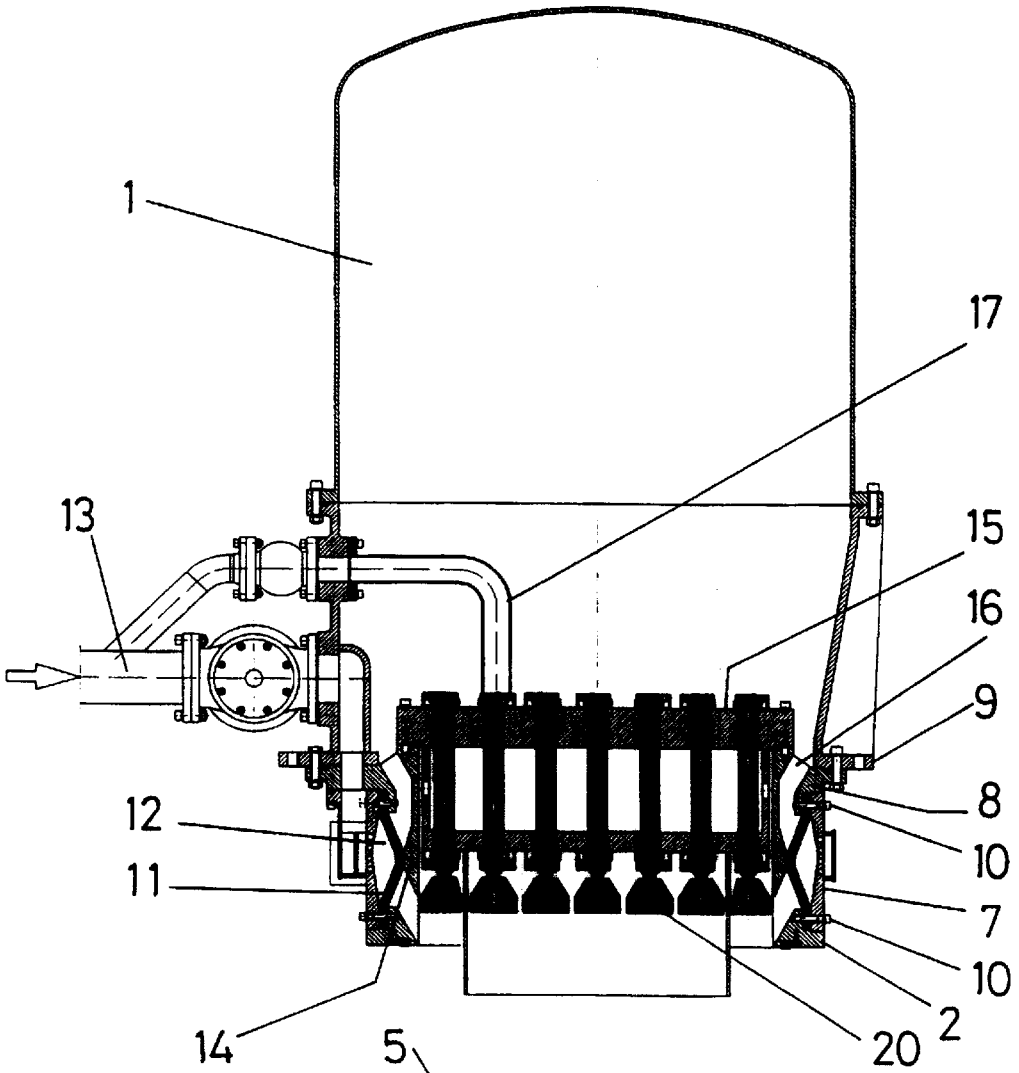
FIG. 5.—Is a representation similar to that of FIGS. 1 and 3, with the same valve system, albeit including an ancillary compacting system comprising hydraulic rams.
Figure 5:
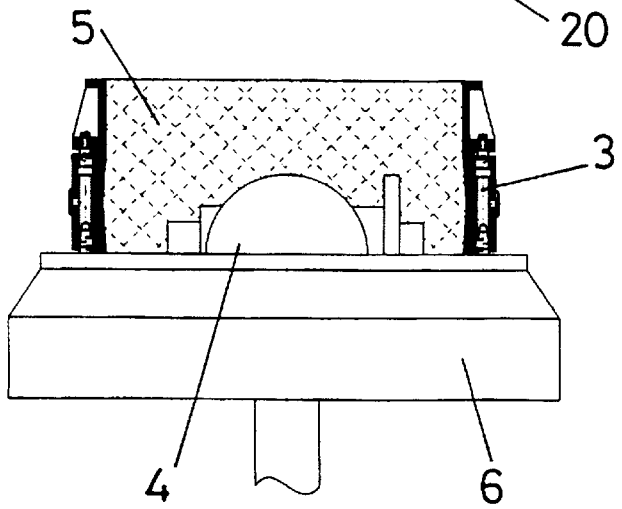

In addition to allowing optimum blowing conditions to be obtained, as described hereinbefore, and since the air passage (16) is arranged facing the marginal or perimetric area of the moulding box, the above-described construction moreover leaves the central machine area absolutely clear, and therefore the residual outlet duct (17) will be located in that area, and the diffuser (2) may at the same time be fixed, with a pan-shaped support (18) located between it and the moulding box (3), for a group of impact rams (19), such as are shown in FIG. 4, or the actual core (15) may be used as a support for a plurality of additional hydraulic compacting rams (20), as shown in FIG. 5.

Figure 6:
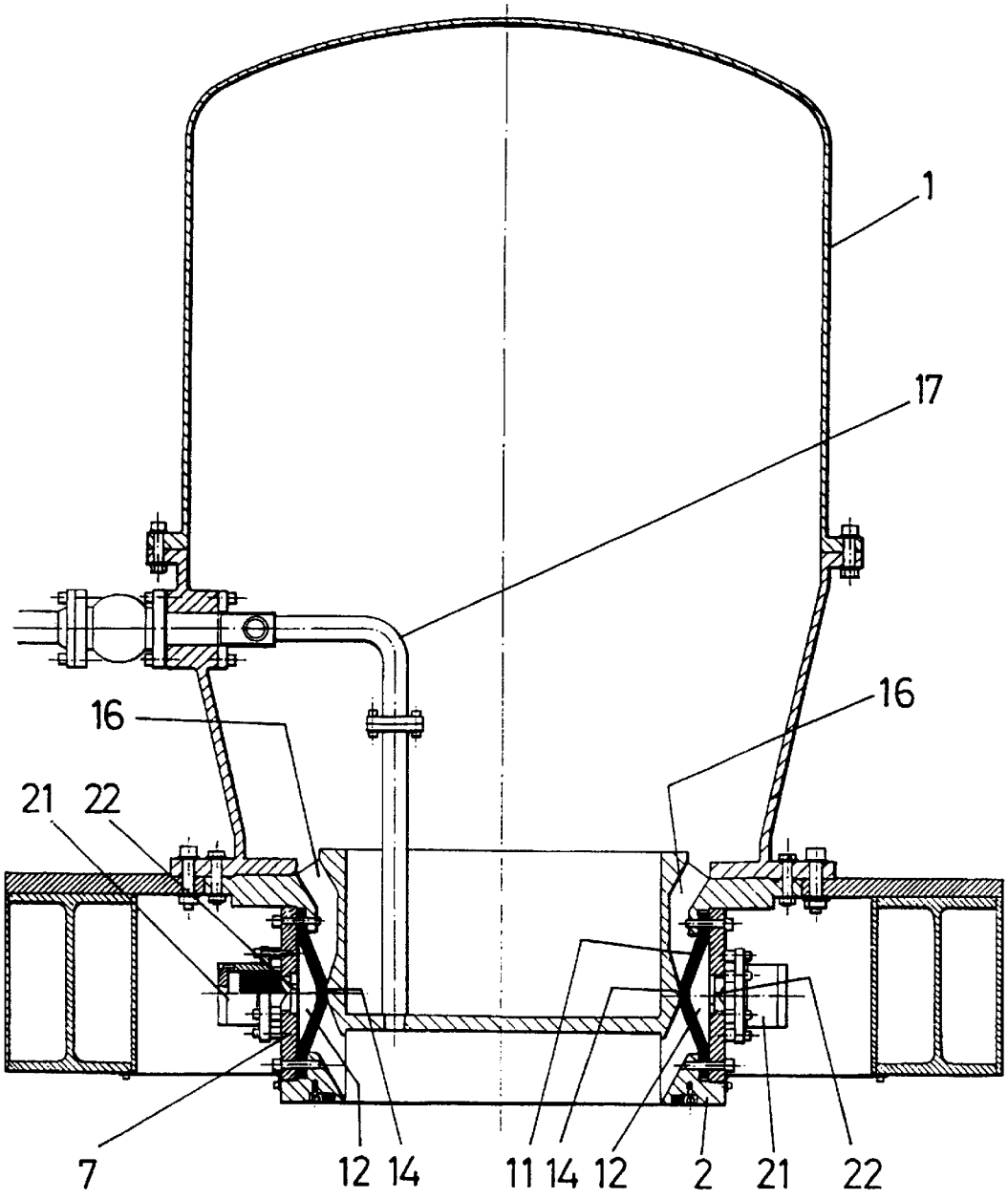
FIG. 6.—Is a representation similar to that of FIG. 1, the embodiment being one in which each membrane sector is associated to a valve. The respective moulding box is not shown in this figure.
Figure 7:
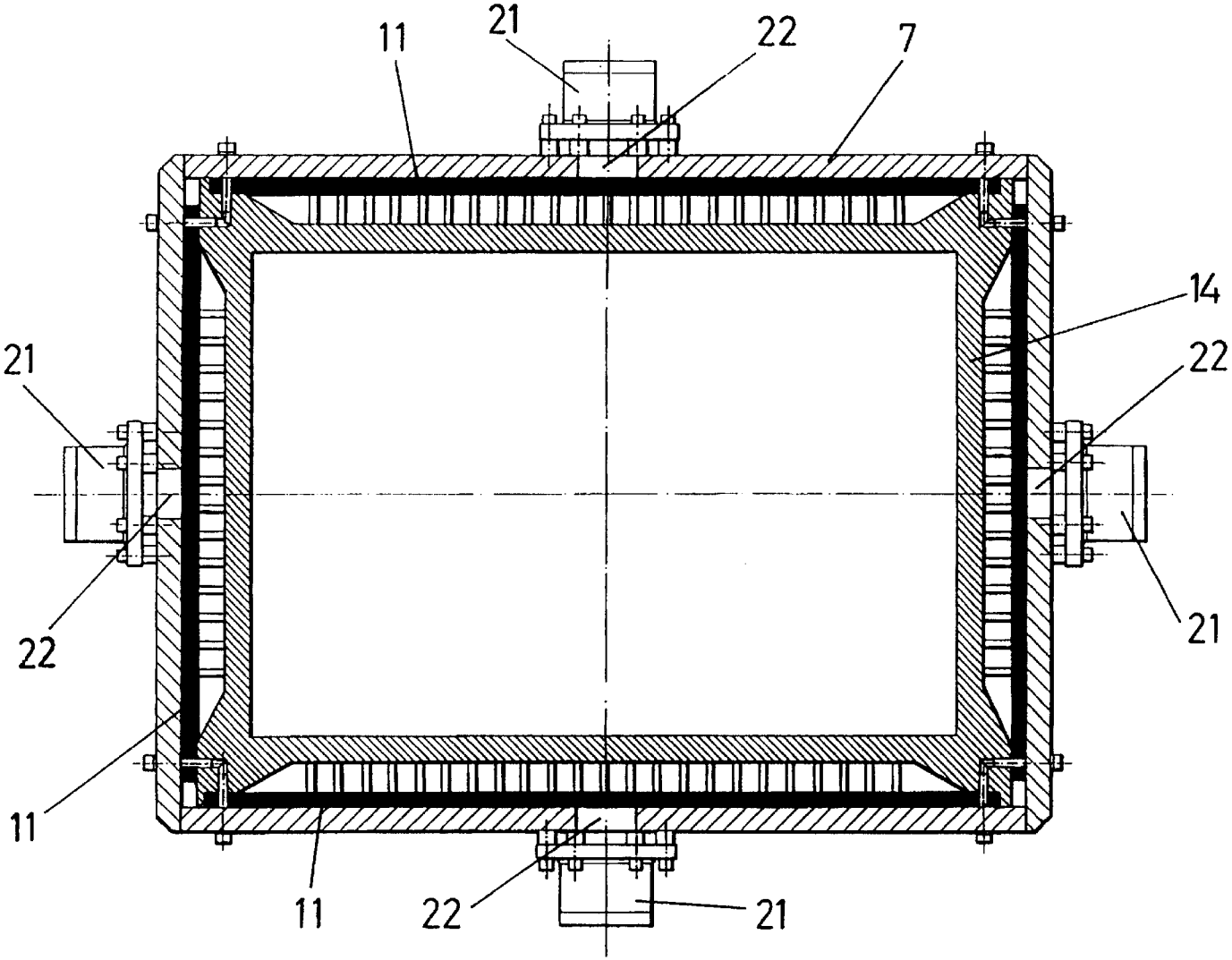
FIG. 7.—Is finally a sectional view as in FIG. 2, albeit of the embodiment of the preceding figure.

In a different embodiment, as shown in figs. 6 and 7, each valve support sector (7) has been designed to include a valve (21), the outlet (22) of which leads directly onto the respective membrane sector (11), the foregoing such that if said valves (21) act simultaneously, the membrane sectors (11) will also work simultaneously, which results in an optimum operation of the machine.

What is claimed is:

1. In a sand mould air impact or blast compacting machine having a compressed air drum (1) for delivering air through a diffuser (2) onto a moulding box (3) for sand (5) to be compacted, the improvements comprising:

a peripheral passage (16) right before the diffuser (2) for the air to be delivered to the diffuser, four independent membranes (11) within the peripheral passage (16), the membranes being solidly attached by marginal areas to valve bodies (7) in order to define respective enveloping chambers (12) for pressurization to deform the membranes (11) towards respective valve seats (14) on a core (15) that defines an inner wall of the peripheral passage (16) such that, when pressure is lost in the enveloping chambers (12), most of the air is delivered at a periphery of the moulding box (3);

wherein the membranes (11) are square or rectangular with dimensions matching the moulding box (3) and their solid attachment by marginal areas to the valve bodies (7) is through screws (10) with which the valve bodies (7) are fixed to an upper supporting frame (8) and the diffuser (2).

2. The sand mould air impact or blast compacting machine as in claim 1, characterised in that facing each of the membranes (11) at the respective valve bodies (7) are respective valves (21) with respective outlets (22) to the respective enveloping chambers (12) for the valves (21) to act simultaneously, the membranes (11) lying directly on the valve bodies (7) in an open position.

3. The sand mould air impact or blast compacting machine as in claim 1, and further comprising a pan-shaped body (18) having an inner wall for a traveling guide for impact rams (19) and a plate supported thereby coupled to the diffuser (2) for the air delivered to the diffuser to act mostly on an outer contour of the plate and consequently on heads of peripheral ones of the impact rams which project against the sand for the compacting.

4. The sand mould air impact or blast compacting machine as in claim 3, characterised in that facing each of the membranes (11) at the respective valve bodies (7) are respective valves (21) with respective outlets (22) to the respective enveloping chambers (12) for the valves (21) to act simultaneously, the membranes (11) lying directly on the valve bodies (7) in an open position.

5. The sand mould air impact or blast compacting machine as in claim 1, wherein a central area of the machine comprises a residual air exhausting duct (17), optionally including ancillary mechanical compacting systems.

6. The sand mould air impact or blast compacting machine as in claim 5, characterised in that facing each of the membranes (11) at the respective valve bodies (7) are respective valves (21) with respective outlets (22) to the respective enveloping chambers (12) for the valves (21) to act simultaneously, the membranes (11) lying directly on the valve bodies (7) in an open position.

7. The sand mould air impact or blast compacting machine as in claim 5, and further comprising a pan-shaped body (18) having an inner wall for a traveling guide for impact rams (19) and a plate supported thereby coupled to the diffuser (2) for the air delivered to the diffuser to act mostly on an outer contour of the plate and consequently on heads of peripheral ones of the impact rams which project against the sand for the compacting.

8. The sand mould air impact or blast compacting machine as in claim 7, characterised in that facing each of the membranes (11) at the respective valve bodies (7) are respective valves (21) with respective outlets (22) to the respective enveloping chambers (12) for the valves (21) to act simultaneously, the membranes (11) lying directly on the valve bodies (7) in an open position.

* * * * *